US011242590B2

(12) United States Patent
Mason et al.

(10) Patent No.: US 11,242,590 B2
(45) Date of Patent: Feb. 8, 2022

(54) CONTINUOUS GALVANIZING APPARATUS FOR MULTIPLE RODS

(71) Applicant: Western Technologies, Inc., Tulsa, OK (US)

(72) Inventors: Christopher Stephen Mason, Tulsa, OK (US); Russell Wayne Patterson, Jenks, OK (US)

(73) Assignee: Western Technologies, Inc., Tulsa, OK (US)

( * ) Notice: Subject to any disclaimer, the term of this patent is extended or adjusted under 35 U.S.C. 154(b) by 47 days.

(21) Appl. No.: 16/411,412

(22) Filed: May 14, 2019

(65) Prior Publication Data

US 2019/0382876 A1 Dec. 19, 2019

Related U.S. Application Data

(63) Continuation-in-part of application No. 15/955,389, filed on Apr. 17, 2018.

(60) Provisional application No. 62/486,593, filed on Apr. 18, 2017.

(51) Int. Cl.

| | |
|---|---|
| ***C23C 2/00*** | (2006.01) |
| ***C23C 2/06*** | (2006.01) |
| ***C23C 2/36*** | (2006.01) |
| ***B05C 3/109*** | (2006.01) |

(52) U.S. Cl.

CPC ..... *C23C 2/003* (2013.01); *B05C 3/109* (2013.01); *C23C 2/06* (2013.01); *C23C 2/36* (2013.01)

(58) Field of Classification Search

None

See application file for complete search history.

(56) References Cited

U.S. PATENT DOCUMENTS

| | | | |
|---|---|---|---|
| 3,281,918 | A | 11/1966 | Leib et al. |
| 3,620,805 | A | 11/1971 | Martin |
| 3,877,975 | A | 4/1975 | Raymond |
| 3,956,537 | A | 5/1976 | Raymond |

(Continued)

FOREIGN PATENT DOCUMENTS

| | | |
|---|---|---|
| CN | 203807541 U | 9/2014 |
| DE | 4105159 | 2/1991 |

(Continued)

OTHER PUBLICATIONS

Korean Intellectual Property Office; International Search Report and Written Opinion; dated Feb. 14, 2020.

*Primary Examiner* — Jethro M. Pence

(74) *Attorney, Agent, or Firm* — Head, Johnson, Kachigian & Wilkinson, PC

(57) ABSTRACT

A continuous galvanizing apparatus for multiple rods. The apparatus includes a kettle for heating and retaining a liquid therein with at least a portion of the kettle having an open top. A trough assembly retains liquid therein. The trough assembly is arranged above the kettle open top above the liquid level, with the trough assembly having at least one lower chamber within the kettle below a level of the liquid in the kettle. A pump in the lower chamber draws liquid from the kettle to the trough assembly. A plurality of entry openings are provided in the trough assembly along with a plurality of exit openings opposed to and aligned with the entry openings. Adjacent tubes in the trough assembly are aligned with the plurality of entry and exit openings.

9 Claims, 5 Drawing Sheets

(56) References Cited

U.S. PATENT DOCUMENTS

| | | | | |
|---|---|---|---|---|
| 4,082,869 | A | 4/1978 | Raymond | |
| 5,338,581 | A | 8/1994 | Delot | |
| 5,506,002 | A | 4/1996 | Maitra et al. | |
| 5,527,563 | A | 6/1996 | Unger et al. | |
| 2006/0147643 | A1* | 7/2006 | Volkov | C23C 2/36 427/431 |
| 2012/0100287 | A1* | 4/2012 | Wong | C25D 21/10 427/127 |
| 2016/0312345 | A1 | 10/2016 | Zheng | |
| 2016/0319446 | A1 | 11/2016 | Zheng | |
| 2019/0002213 | A1 | 1/2019 | Decoster et al. | |

FOREIGN PATENT DOCUMENTS

| | | |
|---|---|---|
| DE | 4340838 | 11/1993 |
| FR | 2647814 | 12/1990 |
| GB | 1546635 | 5/1979 |
| KR | 1019970070250 | 9/2000 |
| KR | 1020010042341 | 12/2003 |
| KR | 1020100079953 | 2/2011 |
| WO | 9602684 | 2/1996 |

* cited by examiner

CONTINUOUS GALVANIZING APPARATUS FOR MULTIPLE RODS

CROSS-REFERENCE TO RELATED APPLICATIONS

This application is a continuation-in-part of U.S. patent application Ser. No. 15/955,389, filed Apr. 17, 2018, which claims priority to and the benefit of U.S. Provisional Patent Application Ser. No. 62/486,593, filed Apr. 18, 2017, each of which is incorporated herein by reference in its entirety.

BACKGROUND OF THE INVENTION

Field of the Invention

The present invention relates to an apparatus to simultaneously galvanize multiple rods and a process therefor. In particular, the present invention is directed to a continuous galvanizing apparatus and a process therefor that can simultaneously galvanize multiple rebar rods continuously without any manual intervention.

Description of the Related Art

The process of galvanizing steel or iron has been known for over a century. A layer of zinc or alloyed zinc forms to the surface of the steel or iron.

Galvanization provides both barrier protection and corrosion resistance.

Hot-dip galvanization is known wherein a metal object is dipped into a liquid bath of the zinc. Upon cooling, the zinc forms a protective barrier coating and provides corrosion resistance. More recently, iron or steel materials have been hot-dipped in a continuous line. In addition, continuous galvanization of items has been performed by passing an item through a flooded trough.

Notwithstanding the foregoing, there remains a need for a continuous galvanizing apparatus and process to simultaneously galvanize a number of items without any manual intervention.

It is desirable to minimize turbulence of the liquid zinc or liquid alloyed zinc as the objects are coating in order to minimize foaming.

There also remains a need to provide a continuous galvanizing apparatus and process which efficiently galvanizes items while minimizing turbulence of the liquid bath.

There also remains a need to provide a continuous galvanizing apparatus and process which minimizes foaming of galvanizing liquid while maximizing galvanizing efficiency.

SUMMARY OF THE INVENTION

The present invention is directed to a continuous galvanizing apparatus for multiple rods. The apparatus includes a kettle for heating and retaining a liquid therein with at least a portion of the kettle having an open top. In one embodiment, the liquid is liquid zinc or liquid zinc alloy.

A trough assembly includes an elongated trough for retaining the liquid therein with the trough arranged above the kettle open top. The trough assembly has at least one lower chamber positioned and located within the kettle below a level of liquid in the kettle.

A pump or pumps in the lower chamber of the trough assembly draws liquid from the kettle and moves it into the lower chamber of the trough assembly. When the lower chamber of the trough assembly has filled, the trough is thereafter filled. An overflow chamber is separated from the trough of the trough assembly by a weir wherein the overflow chamber is in fluid communication with said kettle.

A plurality of entry openings are provided in the trough of the trough assembly. A plurality of exit openings in the trough are opposed to and aligned with the entry openings. Each entry opening includes a tapered entry guide. Each exit opening includes a tapered exit guide.

An angled deflector is positioned beneath the tapered entry guides. Likewise, an angled deflector is positioned beneath the tapered exit guides.

A plurality of adjacent, parallel tubes in the elongated trough of the trough assembly are aligned with the plurality of entry openings and with the plurality of exit openings. Each of the plurality of adjacent tubes includes a plurality of slots in order to permit passage of the liquid.

DETAILED DESCRIPTION OF THE INVENTION

The embodiments discussed herein are merely illustrative of specific manners in which to make and use the invention and are not to be interpreted as limiting the scope.

While the invention has been described with a certain degree of particularity, it is to be noted that many modifications may be made in the details of the invention's construction and the arrangement of its components without departing from the scope of this disclosure. It is understood that the invention is not limited to the embodiments set forth herein for purposes of exemplification.

Figure 1:
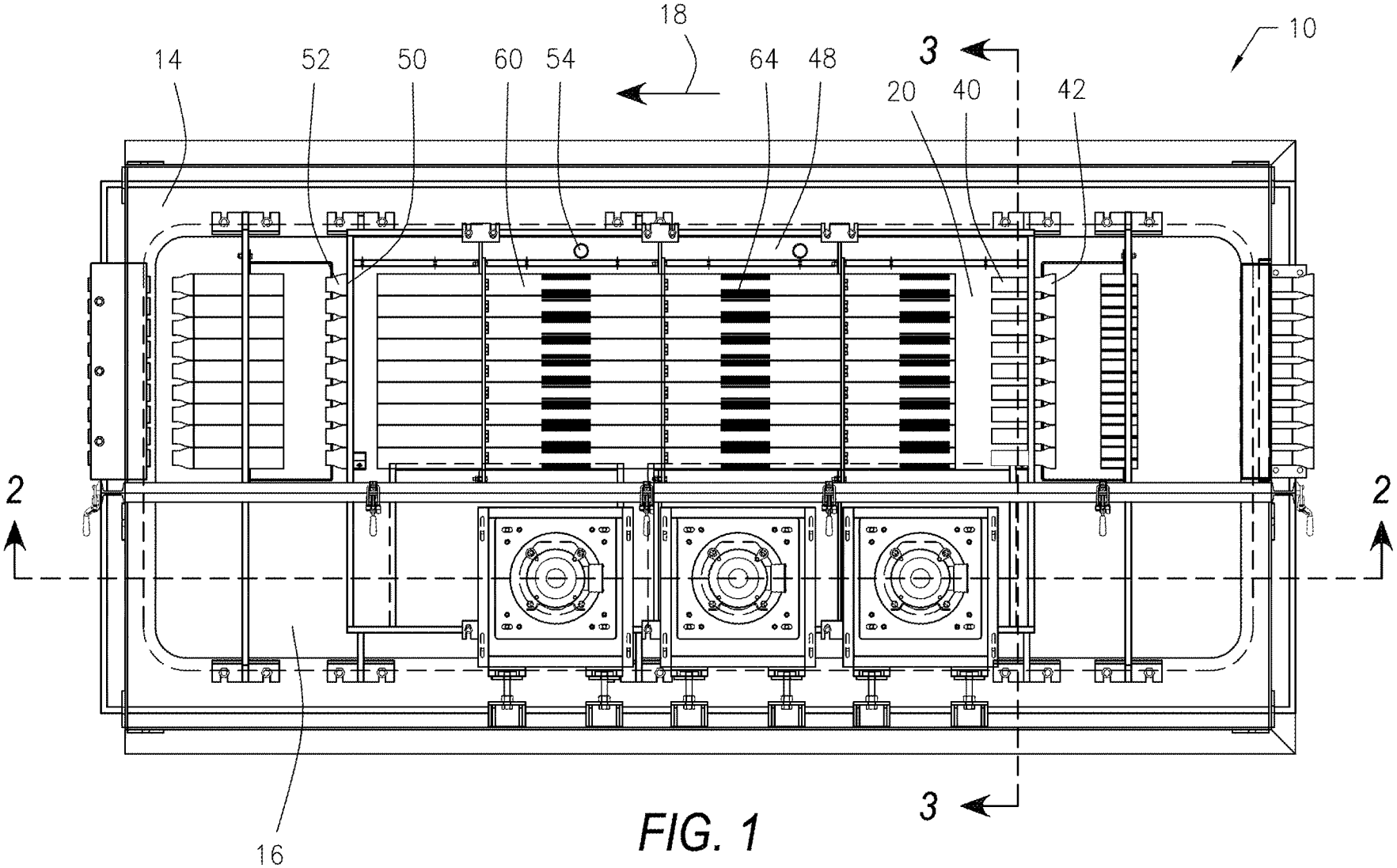
FIG. 1 is a top view of a continuous galvanizing apparatus for multiple rods constructed in accordance with the present invention.

Referring to the drawings in detail, FIG. 1 is a top view of a continuous galvanizing apparatus 10 for multiple rods.

The apparatus 10 contains a liquid reservoir or kettle 12 for heating and retaining a liquid therein.

Figure 2:
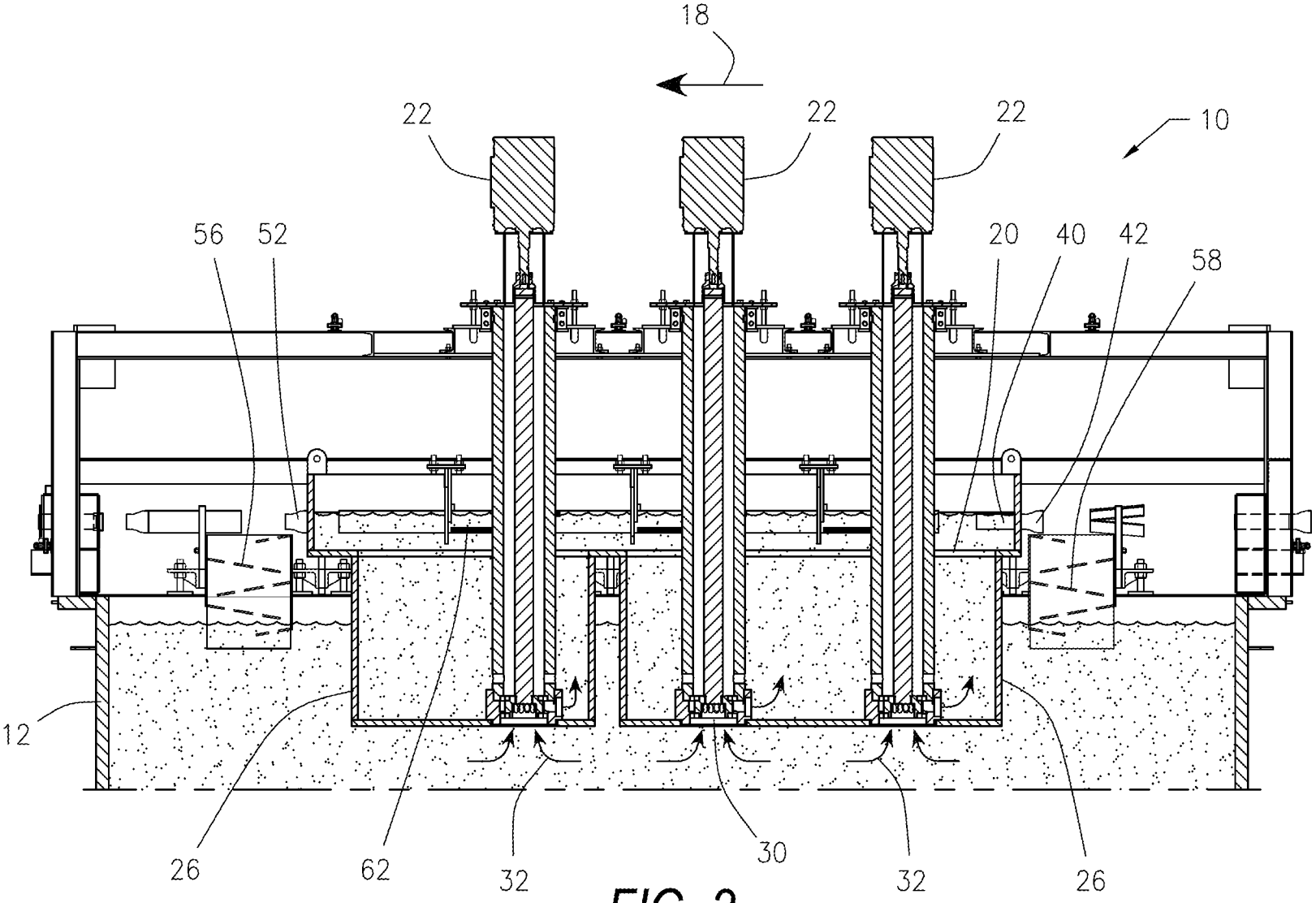
FIG. 2 is a sectional view taken along section line 2-2 of FIG. 1.
Figure 3:
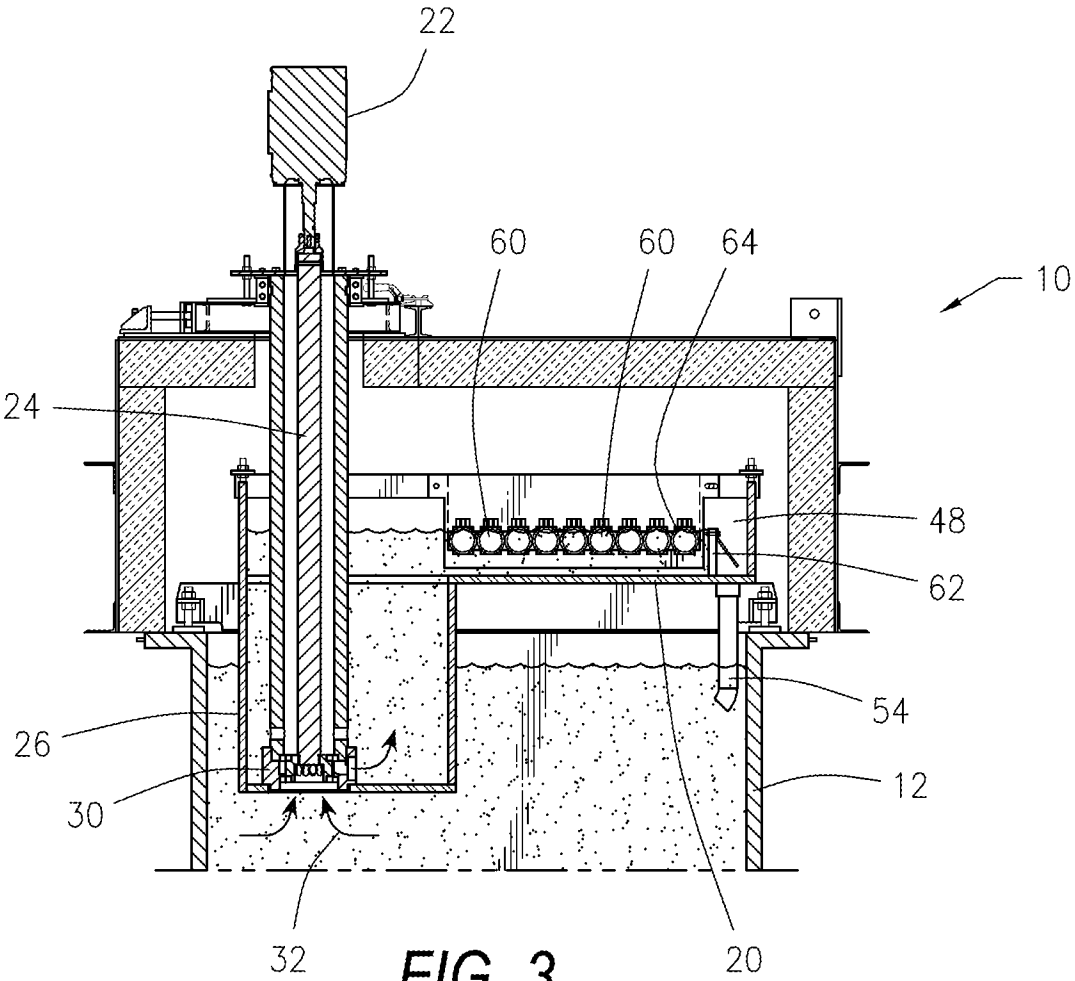
FIG. 3 is a sectional view taken along section line 3-3 of FIG. 1.

FIG. 2 illustrates a view taken along section line 2-2 of FIG. 1 while FIG. 3 illustrates a view taken along section line 3-3 of FIG. 1. The apparatus 10 includes a liquid reservoir or kettle 12 acting as a storage container for the liquid. The kettle 12 is a substantially elongated container which retains and heats a liquid therein. In a preferred embodiment, the liquid is heated liquid zinc or heated zinc and aluminum alloy.

As seen in FIG. 1, a portion 14 of the top of the kettle 12 may be closed although at least a portion 16 of the kettle 12 contains an open top.

A trough assembly is arranged above the open top portion 16 of the kettle 12. The trough assembly includes a trough 20 arranged above an open top of the kettle. Braces or beams support the trough 20 above the kettle.

The trough assembly includes at least one lower chamber 26 which is at least partially within the kettle 12 and at least partially below a level of liquid in the kettle 12.

In the embodiment shown in FIG. 2, two lower chambers 26 are utilized although a different number may be used within the spirit and scope of the present embodiment.

As will be explained, the lower chamber 26 is substantially fluid tight with an open top in fluid communication with the trough 20. In addition, the lower chamber 26 has a series of lower pump inlet openings which operate in conjunction with pumps 30 (to be described). Accordingly, liquid in the trough assembly will initially fill the lower chamber 26 and, as the liquid level rises, thereafter fill the trough 20.

Arrow 18 in FIGS. 1 and 2 illustrates the direction that the rebar (not seen) will travel entering into and passing through the apparatus 10.

Figure 4:
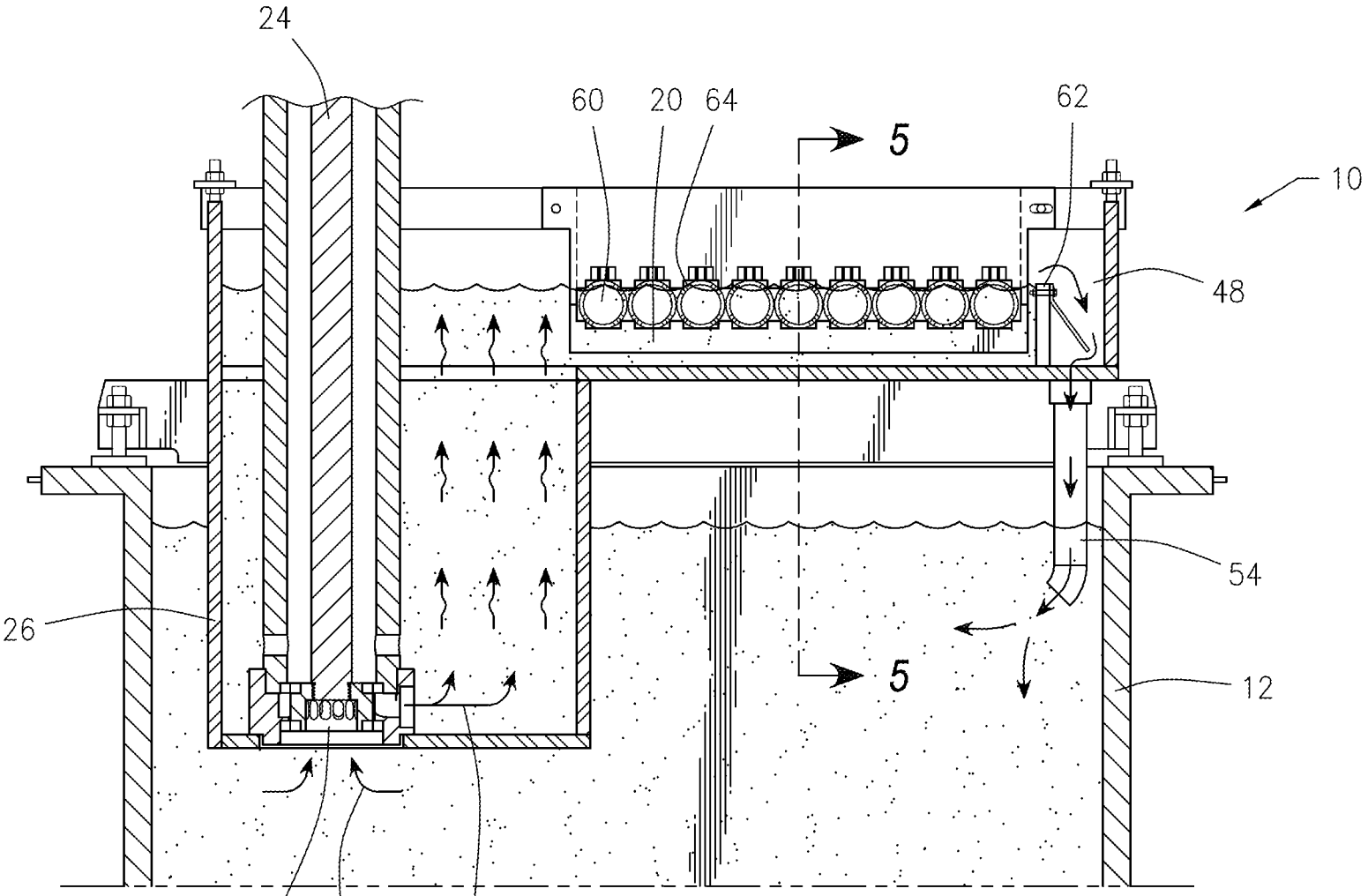
FIG. 4 is an enlarged, partial view of a portion of the apparatus shown in FIG. 3.

As best seen in FIGS. 2, 3, and 4, at least one pump 30 in each lower chamber 26 will draw liquid from the kettle 12 into the lower chamber 26, as shown by arrows 32. In the embodiment shown, three pumps 30 are utilized. Motors 22 connected to the pumps 30 by shafts 24 drive the pumps 30. The motors 22 may be located above the kettle 12.

When the pumps 30 are turned off, zinc is permitted to drain from the lower chamber 26 back through the lower pump inlet openings to the kettle 12.

Figure 5:
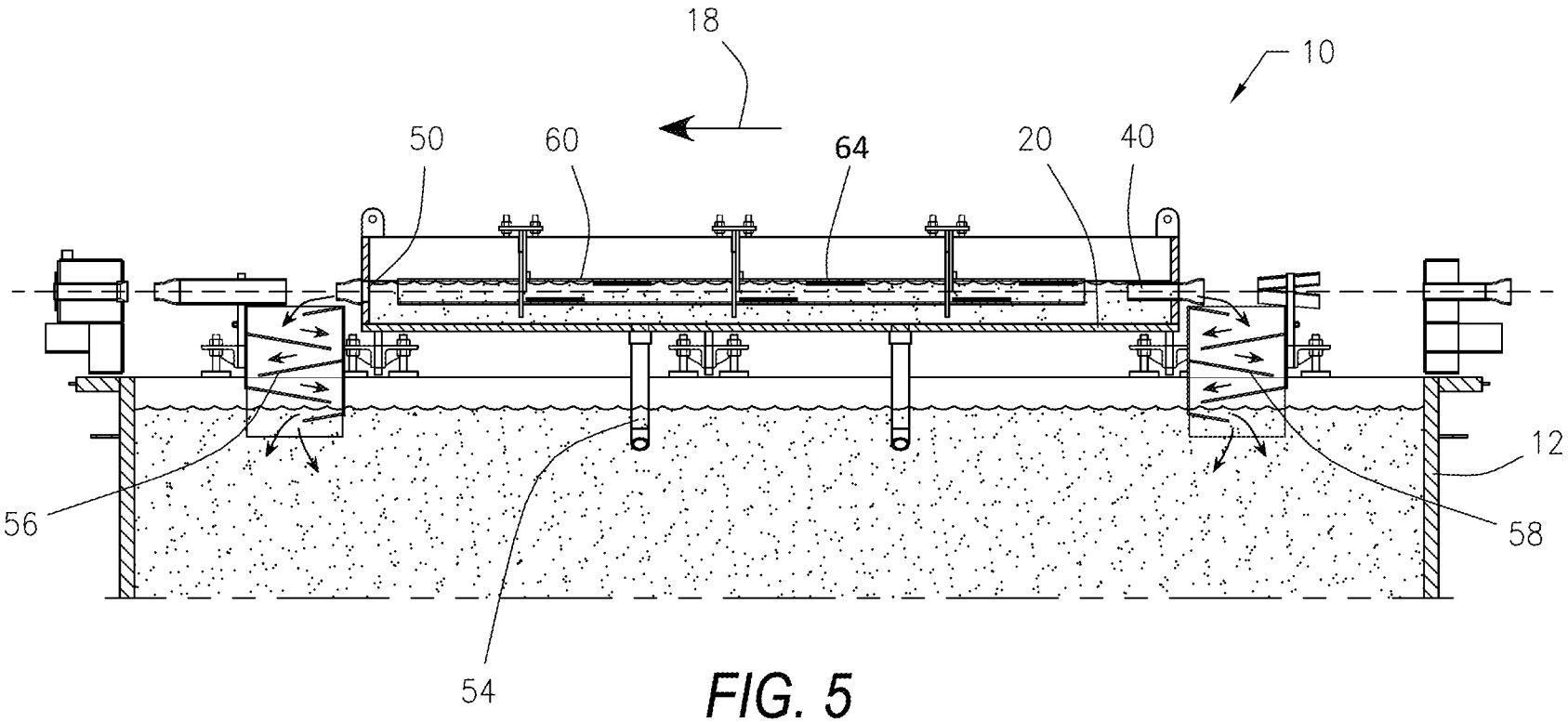
FIG. 5 is a sectional view taken along section line 5-5 of FIG. 4.

As seen in FIGS. 1, 2, and 5, a plurality of entry openings 40 are provided in the trough 20. The entry openings 40 pass through a wall of the trough 20. In the embodiment shown, each entry opening 40 has a tapered entry guide 42 extending from the trough. Accordingly, the entry guide 42 acts as a guide for the incoming metal rods or rebar (not shown).

The trough 20 also includes a plurality of exit openings 50. In the embodiment shown, a tapered exit guide 52 extends from each exit opening 50 and acts as a guide for the metal rods or rebar exiting the trough assembly.

In the trough 20 are a plurality or series of adjacent tubes 60. In the embodiment shown, the tubes 60 are cylindrical and substantially parallel to each other although other arrangements are possible. The tubes 60 extend in a substantially transverse direction within the elongated trough 20. The adjacent tubes 60 are aligned with the plurality of entry openings 40 and aligned with the exit openings 50 so that they provide a guide for the metal rods or rebar passing therethrough.

Each of the tubes has a plurality of slots 64 to permit passage of liquid from the trough 20 into and out of the tubes 60.

The tapered entry guides 42 are above the open top 16 of the kettle 12. Accordingly, liquid from the trough 20 may pass through the entry openings 40, through the tapered entry guides 42, and thereafter fall by gravity into the open top of the kettle. A series of angled deflectors 66 reduce splashing and turbulence of the liquid as it moves toward the kettle.

Likewise, the tapered exit guides 52 are above the open top of the kettle 12. A series of exit angled deflectors 70 reduce splashing and turbulence of the liquid as it moves toward the kettle.

A drain or drains 54 assists in permitting liquid to return to the kettle 12. Accordingly, the liquid moves in a continuous loop from the kettle 12 into the lower chamber of the trough assembly, into the trough 20, into the adjacent tubes where the rebar is galvanized, over a weir 62, and back to the kettle 12.

Returning to a consideration of FIGS. 2 and 5, an angled deflector or deflectors 56 are positioned beneath the tapered entry guides.

Likewise, an angled deflector or deflectors 58 are positioned beneath the tapered exit guides.

Returning to a consideration of FIGS. 1, 3, and 4, an overflow chamber 48 is separated from the trough 20 by the weir 62.

Whereas, the invention has been described in relation to the drawings attached hereto, it should be understood that other and further modifications, apart from those shown or suggested herein, may be made within the scope of this invention.

What is claimed is:

1. A continuous galvanizing apparatus for multiple rods, said apparatus comprising:

a kettle for heating and retaining a liquid therein, at least a portion of said kettle having an open top;

a trough assembly for retaining said liquid therein, said trough assembly having a trough arranged above said open top and said trough having a base, said trough assembly having at least one lower chamber within said kettle wherein at least a portion of said at least one lower chamber is below a level of said liquid in said kettle;

a pump in said lower chamber to draw said liquid from said kettle to said trough assembly such that the trough is supplied the liquid from said lower chamber at a level of the base of the trough; and a plurality of entry openings in said trough assembly positioned above said open top of said kettle and a plurality of exit openings in said trough opposed to and aligned with said entry openings and positioned above said open top of said kettle wherein said liquid is permitted to fall by gravity from said plurality of entry openings and said plurality of exit openings to said kettle, and a plurality of adjacent tubes having a cylindrical inner surface and a cylindrical outer surface, each of said plurality of adjacent tubes passing through said trough above a level of said base, aligned with said plurality of entry openings and said plurality of exit openings wherein each of said plurality of adjacent tubes includes a plurality of slots to permit passage of said liquid.

2. The continuous galvanizing apparatus for multiple rods as set forth in claim 1 wherein each said entry opening includes a tapered entry guide.

3. The continuous galvanizing apparatus for multiple rods as set forth in claim 1 wherein each said exit opening includes a tapered exit guide.

4. The continuous galvanizing apparatus for multiple rods as set forth in claim 2 including an angled deflector beneath said tapered entry guides.

5. The continuous galvanizing apparatus for multiple rods as set forth in claim 3 including an angled deflector beneath said tapered exit guides.

6. The continuous galvanizing apparatus for multiple rods as set forth in claim 1 wherein said rods are metal rebar rods.

7. The continuous galvanizing apparatus for multiple rods as set forth in claim 1 wherein each of said plurality of adjacent tubes is cylindrical and parallel to each other.

8. The continuous galvanizing apparatus for multiple rods as set forth in claim 1 including an overflow chamber separated from said trough by a weir and wherein said overflow chamber is in fluid communication with said kettle.

9. The continuous galvanizing apparatus for multiple rods as set forth in claim 1 wherein said liquid is liquid zinc or liquid zinc alloy.

* * * * *